United States Patent [19]

Bernard et al.

[11] Patent Number: 4,485,596

[45] Date of Patent: Dec. 4, 1984

[54] TWIST DRILL POINT SPLITTING/WEB THINNING APPARATUS

[75] Inventors: David A. Bernard; Richard A. Bernard; William C. Christian, all of Ashland, Oreg.

[73] Assignee: Darex Corporation, Ashland, Oreg.

[21] Appl. No.: 416,281

[22] Filed: Sep. 9, 1982

[51] Int. Cl.[3] ..... B24B 19/00

[52] U.S. Cl. ..... 51/219 R; 51/219 PC

[58] Field of Search ..... 51/219 R, 219 PC, 225, 51/165.8, 165.81

[56] References Cited

U.S. PATENT DOCUMENTS 1,148,524 8/1915 Murray ..... 51/225
2,363,482 10/1942 Clarke ..... 51/219 PC
4,001,975 1/1977 Bernard et al. ..... 51/5 R
4,093,247 6/1978 Bernard et al. ..... 279/53

*Primary Examiner*—Frederick R. Schmidt
*Assistant Examiner*—Matthew D. Daschel
*Attorney, Agent, or Firm*—Kerkam, Stowell, Kondracki & Clarke

[57] ABSTRACT

A fluted twist drill point splitting/web thinning apparatus is disclosed which permits simple point splitting-/web thinning of conventional sharpened twist drills. The apparatus is uniquely designed such that either of the two operations, that is point splitting or web thinning, can be simply and accurately carried out with the same assembly. The apparatus also includes the provisions of a grinding wheel dressing diamond mounted on a forward face of the apparatus.

2 Claims, 20 Drawing Figures

TWIST DRILL POINT SPLITTING/WEB THINNING APPARATUS

REFERENCE TO RELATED SUBJECT MATTER

Related subject matter is disclosed and claimed in U.S. Pat. No. 4,001,975 Bernard et al; U.S. Pat. No. 4,093,247 Bernard et al; and in U.S. patent application Ser. No. 416,280 filed Sept. 9, 1982 and titled "Universal Twist Drill Sharpener Apparatus", Bernard et al.

TECHNICAL FIELD

This invention relates to a precision, relatively inexpensive twist drill point-splitting/web-thinning apparatus which is used in conjunction with any standard bench or pedestal rotary grinder.

BACKGROUND OF THE INVENTION

Common twist drills are a very standardized tool and when purchased new the geometry at the cutting end of twist drills is a standardized geometry generally selected by the Metal Cutting Tool Institute as the best geometry for all general purpose drilling and is an included point of 118°, a lip relief angle of 6° to 18° (depending on drill diameter), a chisel edge angle of 120°-130°, and the center of the chisel edge accurate to within 0.003 inch with the axis of the drill. The common twist drill with the standard geometry described above is only about 70% efficient in drilling. The reason for this is, that the center of the drill cutting edge called the chisel edge, that is formed by the web of the drill does no actual cutting, but rather pushes metal out of the way. This requires more drilling horse-power and causes more drill and part heating. It is possible to modify the web of the drill to decrease or eliminate the disadvantage that the drill web creates. In the industry this is known as web thinning or point splitting.

Even though web modification is desirable it is seldom done. The reason for this is that it is very difficult to do by hand grinding and machines that can do it are extremely expensive and complicated to set-up and operate. It is therefore one of the primary objects of the present invention to provide a precision twist drill point splitter and web thinning fixture particularly designed for use with the improved Universal Twist Drill Sharpener Apparatus disclosed and claimed in application Ser. No. 416,280 filed Sept. 9, 1982, thereby extending the utility of said apparatus to permit sharpening of twist drills and further by being able to split points and/or thin webs.

The apparatus includes a separately handled drill chuck having low cost sheet metal stampings which perform as jaws, and dual function jaw springs. The jaw springs force the jaws open and keep them against the inside wall of the chuck body and they also hold the jaws so they remain parallel to each other in the chuck body. Details of the chuck are shown and described in co-pending application filed even date herewith and titled Universal Twist Drill Sharpener Apparatus.

The apparatus includes a fixture, separate from the drill point splitting/web thinning fixture which has two purposes, namely, (1) to establish an exact dimension between the tip of the drill and one of the two cams before the drill is gripped by the jaws of the chuck, and (2) to very accurately align the two cutting lips of the drill with one of the cams.

The primary fixture of the present invention has a drill chuck supporting cradle which is mounted for limited rotation on a tiltable cross feed table. The cradle is provided with a band or bridge which is affixed at one side on the cradle and attached to the other side via an eccentric so that the band can be tightened to hold the chuck in fixed relation to the cradle. The cross feed table is supported by a standard which standard has a pair of stop pins which limit the pivotal movement of the table.

BRIEF DESCRIPTION OF THE DRAWINGS

The invention will be described in greater detail in reference to the accompanying drawings wherein.

DESCRIPTION OF THE PREFERRED EMBODIMENTS

Figure 1:
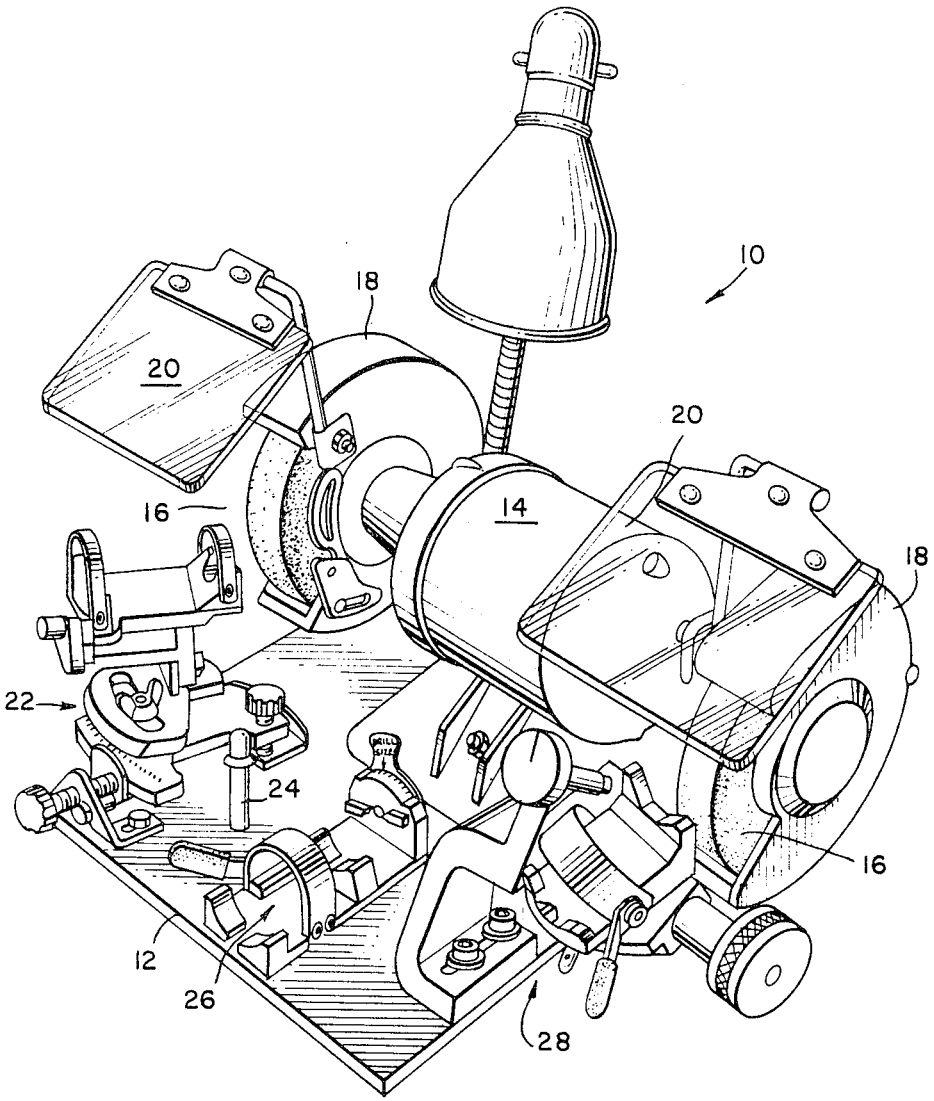
FIG. 1 is a perspective view of various elements of the improved drill sharpening attachment of this invention shown in conjunction with a conventional double-ended grinder and a fixture for twist drill point splitting-/web thinning described in detail in our co-pending application.
Figure 2:
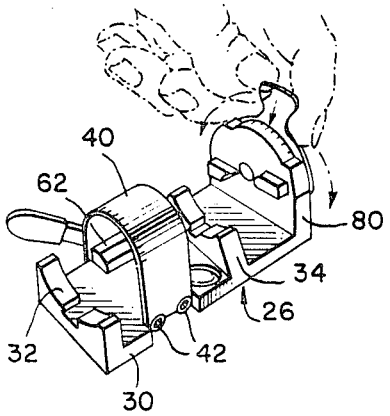
FIG. 2 is a perspective view of a relief setting fixture employed in conjunction with the drill chuck for establishing the proper relationship between the twist drill and its attached cam.
Figure 3:
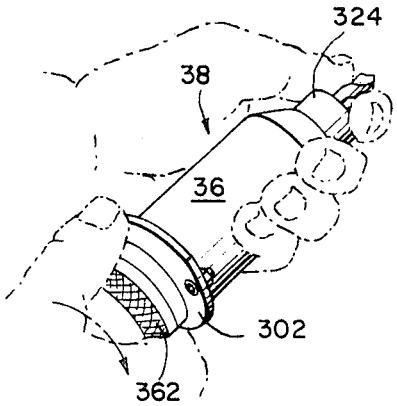
FIG. 3 is a perspective view of the chuck with the drill bit loosely inserted therein.

Referring to FIG. 1 of the drawings, 10 generally designates a drill sharpening device comprising a platform 12 to which is mounted an electric motor 14 having double ended output shafts which carry grinding wheels 16 and conventional guards and eye shields 18 and 20.

The platform 12 mounts a drill sharpening fixture generally designated 22 disclosed and claimed in said co-pending application; a diamond wheel dressing tool 24, a relief setting fixture generally designated 26, and a point splitting/web thinning apparatus generally designated 28.

RELIEF SETTING APPARATUS

Figure 15:
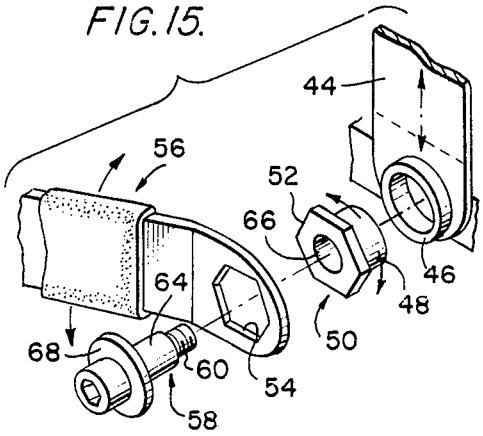
FIG. 15 is an enlarged exploded view of the chuck locking mechanism of the fixture shown in FIG. 10.

Referring particularly to FIGS. 2 through 9 and 15, the relief setting fixture 26 comprises a baseplate 30 having a pair of spaced upstanding cradle members 32 and 34, which cradle members are adapted to support the barrel portion 36 of a special drill holding chuck generally designated 38 which drill holding chuck will be described in greater detail hereinafter. Mounted between the pair of cradles 32 and 34 is plastic bridge 40 mounted on one side of the base 30 by screws 42. The other side of the bridge 40 is provided with means for tightening the bridge about the chuck 30'. These structures will be described in reference to FIG. 15 showing an identical assembly employed with the point splitting-/web thinning fixture 28. In FIG. 15 end 44 of the bridge is provided with a rigid sleeve 46 which rigid sleeve rotatably receives the barrel portion 48 of an eccentric generally designated 50 having a hex end 52. The hex end 52 is received in a corresponding opening 54 in a handle element generally designated 56. The barrel 46, the eccentric 50 and the operating arm or lever 56 are maintained in assembled relationship on a shaft generally designated 58 which shaft is threaded as at 60 and received in a corresponding threaded bore in element 62 integral with the base 30 of the fixture. A shank portion 64 is rotatably received in bore 66 of the eccentric 50 and a shoulder 68 maintains the assembly in operable relation.

Figure 4:
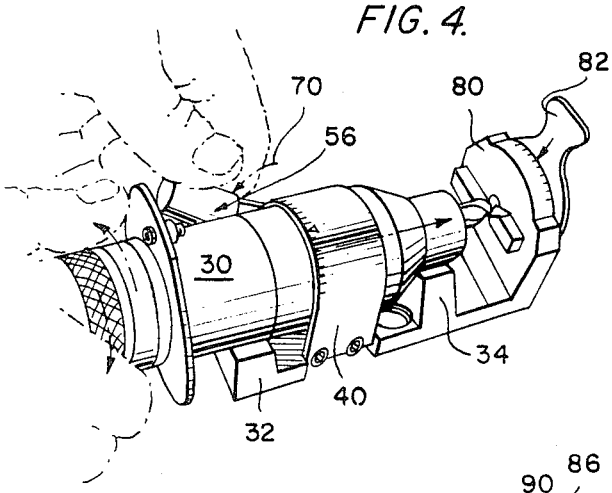
FIG. 4 illustrates a step in properly positioning the drill in the drill chuck.
Figure 5:
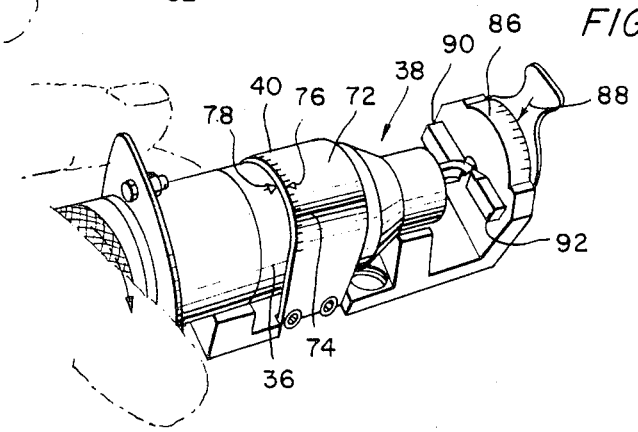
FIG. 5 illustrates another step in aligning the twist drill with the chuck in the fixture illustrated in FIG. 2.

It will be seen that rotating the handle or lever 56 in one direction enlarges the bridge or band 40 and rotation in the opposite direction shortens the bridge or band 40 relative to the top surfaces of cradles 32 and 34, whereby when the chuck 38 is positioned in the fixture as shown, for example, in FIG. 4, movement of the lever 56 in the direction of the directional arrow 70 causes the band to tightly engage a substantial portion of the barrel surface 36, rigidly holding the chuck in a fixed position in the fixture.

The band 40 has indicia on its top surface 72 as indicated at 74 which indicia includes an arrowhead 76. The arrowhead 76 indicates the proper location of a corresponding arrowhead 78 on the barrel portion of the chuck 38 for a 12° relief angle. Moving the chuck carried arrowhead 78 to the left (FIG. 5) increases the relief angle and moving it to the right of the arrow 76 reduces the relief angle.

At the end of the base 30 of the fixture 26 from the saddle 32 is an upstanding wall 80 which wall rotatably supports a drill-size lever arm 82. The lever arm 82 is pivotally mounted to the back of the wall 80 on pivot pin 84. The top surface 86 of the wall 80 has imprinted thereon indicia indicating drill size such as 1/16, $\frac{1}{8}$, $\frac{1}{4}$ etc. to $\frac{3}{4}$. The front face of the lever arm 82 is provided with an indicator arrow 88 so that when the indicating arrow is aligned with the indicia 86 indicating $\frac{1}{4}$ the movable pawls 90 and 92 are positioned such that the tips 94 of FIG. 8 will grasp the flutes on a $\frac{1}{4}$ inch drill and properly position the flutes for the actual sharpening procedure. Further, when the chuck 38 holding the drill is fully inserted in the fixture 26, the distance between the drill point and any fixed point on the chuck is properly dimensioned.

Figure 6:
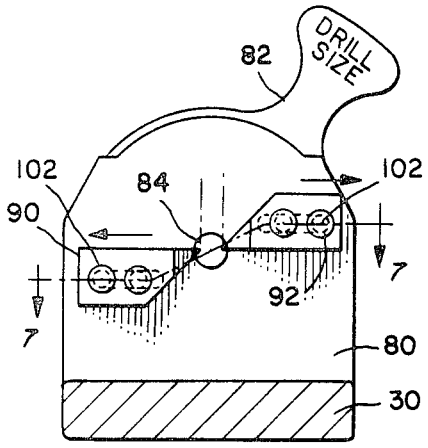
FIG. 6 is an enlarged partial fragmentary view of the twist drill flute engaging pawls of the fixture illustrated in FIG. 2.
Figure 8:
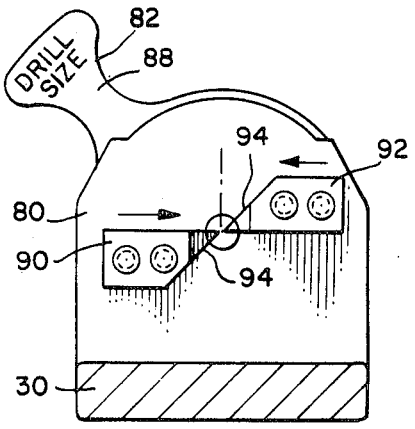
FIG. 8 is a view like FIG. 6 showing the flute engaging elements in another position.
Figure 7:
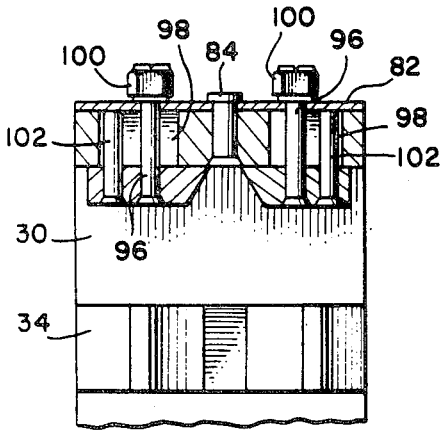
FIG. 7 is a sectional view on line 7—7 of FIG. 6.
Figure 9:
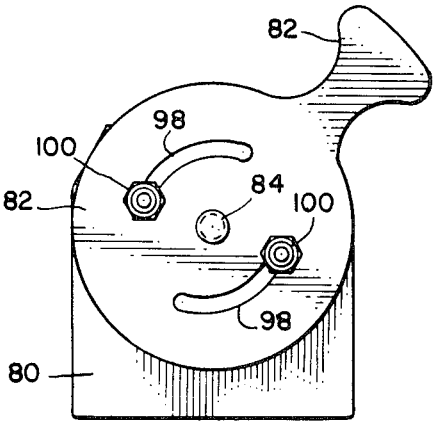
FIG. 9 is the far end view of the structure shown in FIGS. 6–8.
Figure 10:
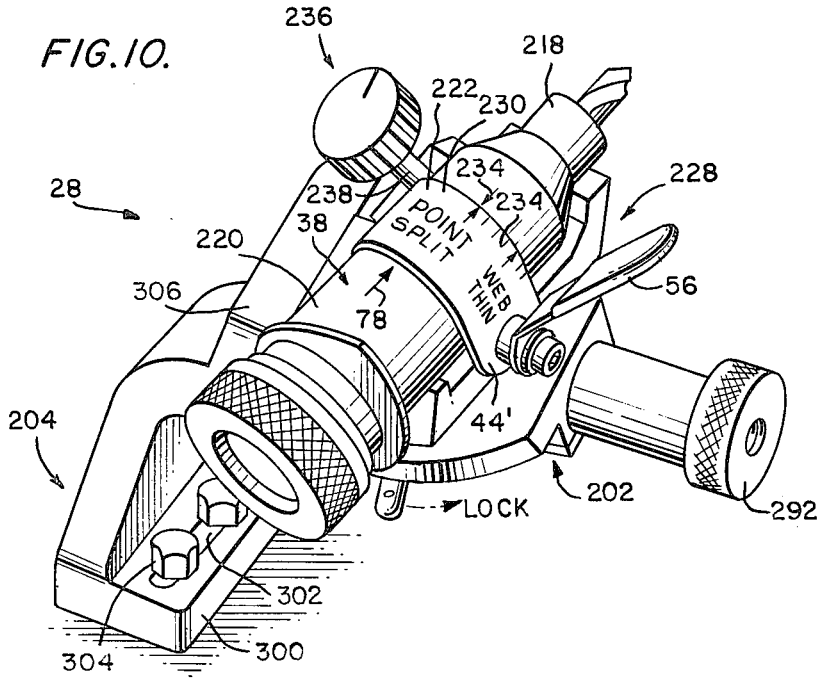
FIG. 10 is a perspective view of the point splitting/web thinning apparatus with the drill chuck in the proper postition for point splitting.
Figure 11:
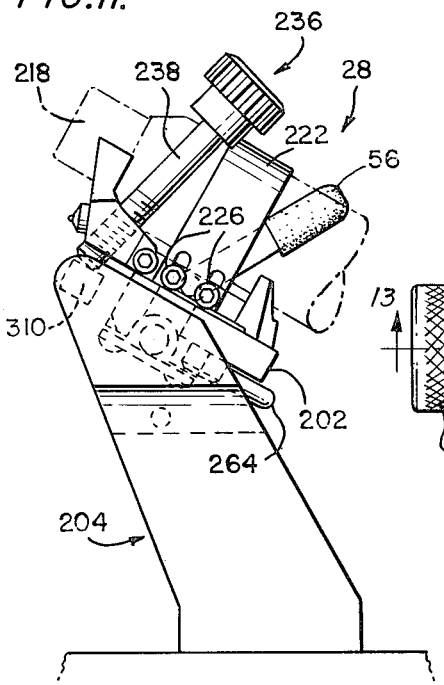
FIG. 11 is a side view of the structure shown in FIG. 10.
Figure 12:
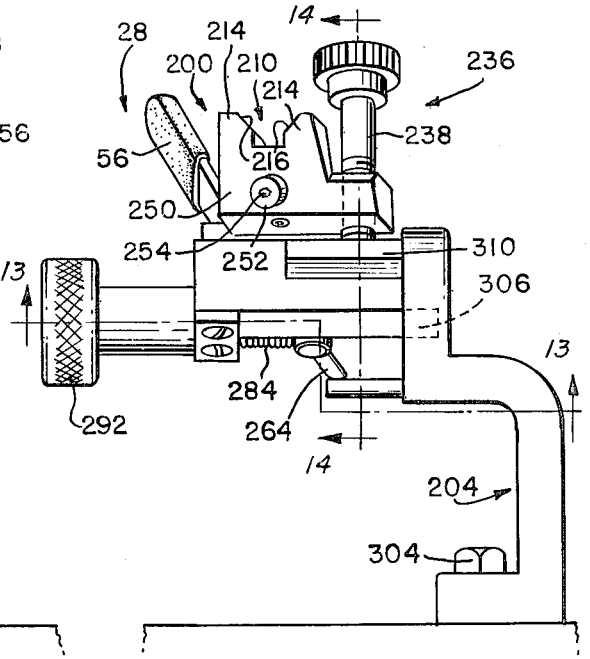
FIG. 12 is a front end view of the structure shown in FIGS. 10 and 12.

The flute engaging pawls 90 and 92 are moved in the direction of the directional arrows, FIGS. 6 and 8, in a transverse sliding movement. The pawls are connected to studs 96 which pass through slots 98 in the upstanding web 80 which slots are illustrated in FIG. 7. The extended ends of the studs 916 pass through arcuate slots 98 in the lever 82 and are maintained in that position by self-locking nuts 100. In order to prevent rotation of the pawls 90 and 92 each of the pawls carries a pin 102 which pins have diameters to be snugly received in the slots 98 in the web 80. The two pins 96 and 102 in each pawl translate the rotational movement of the lever 82 and the arcuate slots 98 into transverse linear movement.

POINT-SPLITTING/WEB-THINNING APPARATUS

Referring to FIGS. 10 through 16, the point-splitting-/web-thinning apparatus comprises a chuck holding cradle or support 200. The cradle 200 has front bearing means 210 and rear bearing means 212. The front and rear bearing means 210 and 212 are in the form of upstanding webs 214 having generally inwardly facing sloping wall portions 216. The sloping faces engage at the front end the cylindrical nose portion 218 of the chuck 38 which chuck is described and claimed in copending application entitled "Universal Twist Drill Sharpener Apparatus" whereas the rearward sloping faces engage the cylindrical barrel portion 220 of the chuck.

Figure 16:
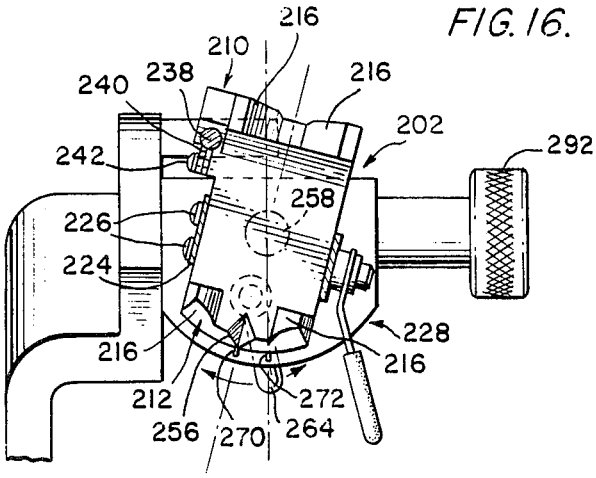
FIG. 16 is a fragmentary top plan view of the point splitting/web thinning apparatus and FIGS. 17, 18, 19 and 20 illustrate top and side views of drills having split points and thinned webs.

The chuck support 200 includes a band 222 which is attached at one side 224 by screws 226, FIG. 16 of the drawing. The other end of the band, designated 44', is attached to the opposite side of the support 200 via an eccentric arrangement 228, which is identical to that hereinbefore described in reference to the flute setting apparatus 26 and illustrated in FIG. 15 of the drawing.

The band 222 is provided with indicia comprising a pair of arrows 230 and 232 with arrow 230 designating the point splitting position for the chuck 38 and the arrow 232 designating the proper position for web thinning when the chuck carried arrow 234 is aligned with one or the other of the arrows 230 or 232.

Figure 14:
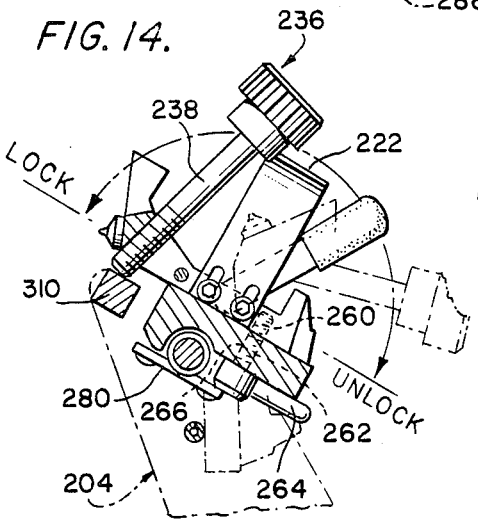
FIG. 14 is a section on line 14—14 of FIG. 12.

The chuck support 200 has mounted adjacent its forward end a feed screw and knob assembly 236. The shaft 238 of the feed screw assembly, as seen in FIG. 14, is threadedly mounted in a threaded bore in the chuck support. The bore is interrupted by a slot 240, having a locking screw 242 associated therewith so that the feed knob assembly may be adjusted for a firm fit to prevent uncontrolled movement of the feed assembly.

Where desired, the front wall 250 of the chuck support 200 may be provided with a fitting 252 mounting a diamond 254 to expedite facing of the grinding wheel. In point splitting and web thinning it is essential that the grinding wheel be provided with a sharp edge between the peripheral and the side face thereof.

The rearward end of the chuck supporting member 200 is provided with a marking 256 the function of which will be described hereinafter.

The chuck support 200 is mounted for limited rotary motion on the cross feed table 202. The mounting means includes a pin 258 projecting downwardly from the center of the chuck support 200 to engage a bore in the cross feed table 202. Adjacent the rear of the chuck support 200 the support 200 is bored and tapped as at 260 to receive the co-operating threads of a locking lever 262, which locking lever has an operating arm 264. The shaft 266 of the locking lever is movable in a arcuate slot 268, FIG. 13 of the drawing, so that when the locking lever 262 is in the unlocked position, the chuck support 200 may be pivoted relative to the cross-feed table 202 to the limits of the arcuate slot 268, so that the indicia 256 on the chuck support can be aligned with one or more markings 270 and 272 on the cross-feed table.

Figure 13:
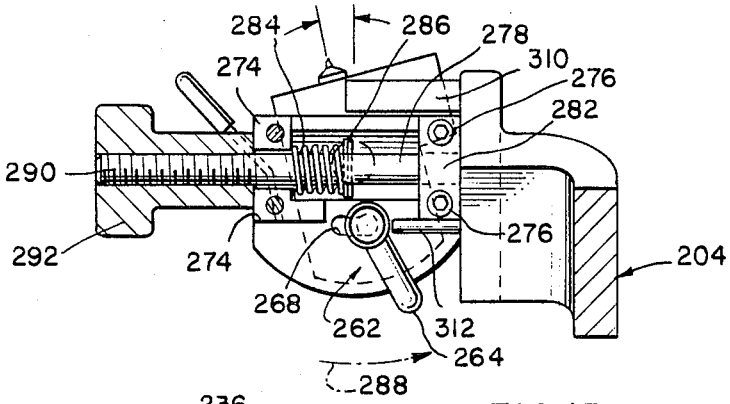
FIG. 13 is a section on line 13—13 of FIG. 12.

Below the cross-feed table are two pairs of bosses or boss portions, FIG. 13 and 14, designated 274 on one side and 276 on the opposite side of the cross-feed table. The spacing between the two pairs of bosses 274–276 is such that therebetween there is mounted a cross-feed shaft 278. The cross-feed shaft is maintained in its proper relationship to the cross-feed table by a pair of bearing plates 280 and 282 which are connected by screws to their respective bosses. The cross-feed shaft has mounted thereon a coil spring 284 which bears against a web between bosses 274 at one end, and at the other is engaged by a cross pin 286. Thus, the cross-feed table is continuously urged by the spring in the direction of the directional arrow 288, FIG. 13 of the drawing. The extended end 290 of the cross-feed shaft 278 is threaded and mates with threads on the cross-feed knob 292 whereby rotation of the cross-feed knob 292 causes the table to move in one direction against the tension of the spring 284, while rotation in the opposite direction permits the spring 284 to move the table in the opposite direction.

The apparatus is completed by a standard, generally designated 204. The standard has a base portion 300 provided with a slot 302 to receive mounting bolts 304. The standard is provided with an upstanding plate 306 to which is mounted the end of cross-feed shaft 278 as shown in broken lines at 308, FIG. 12 of the drawing. The upstanding face 306 also supports a pair of stop members 310 and 312. The stop member 310 is engagable by the feed screw 238 as illustrated, for example, in FIGS. 11 and 14. By turning the feed screw 238, the cross-feed table and its attached chuck support are caused to rock or rotate on the longitudinal axis of the cross-feed shaft 278. The stop member 312 is provided to maintain a limit of movement for rocking of the cross feed table in the opposite direction.

Figure 17:
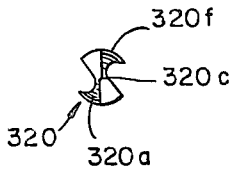
Figure 18:
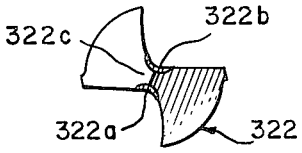
Figure 19:
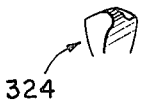
Figure 20:
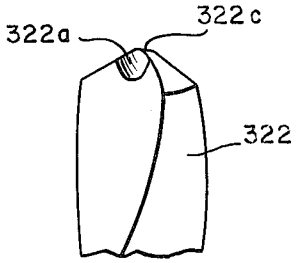

Before describing the operation of the point splitting-/web thinning apparatus, references should be had to FIGS. 17 through 20, depicting the top and side elevational view of drills having their points split or their webs thinned. In FIG. 17, 320 denotes a top view of a drill having its web split, and the shaded portions 320*a* and 320*b* denote zones where metal is removed to make the point 320*c* thinner, and the sidewalls tapering to provide a drill having particularly advantageous cutting qualities. In FIG. 19, 324 denotes a fragmentary side elevational view of the point split drill 320. In FIG. 18, the top view of the drill 322 illustrates at 322*a* and 322*b* zones where metal is removed to thin the point 322*c*. In FIG. 20, the drill shown in FIG. 18 is illustrated in side elevation.

OPERATION

Operation of the drill point splitting/web thinning apparatus will be described in a procedure for point splitting a ¼ inch twist drill having two flutes and sharpened with a point angle of 118° and a lip relief of 12°.

The first step is to set the drill size, that is, ¼ inch on the relief setting fixture 26 by movement of the handle 82. The drill is then inserted loosely in the chuck 38 so that the drill protrudes approximately one inch from the end of the chuck. The chuck gripping band 40 is then loosened using lever 56 and the chuck containing the loosely fitting drill is inserted in the relief setting fixture as far as it will go, FIG. 4 of the drawing. The point of the drill should then butt against the face 80 of the relief setting fixture, and the drill will push into the chuck to the proper length. The chuck containing the drill is then slowly rotated clockwise until the alignment arrow 78 is aligned with the 118° marking 76, FIG. 5 of the drawing. This properly aligns the drill flutes in reference to the arrow 78. The chuck is then secured by depressing the grip lever 56, then the drill grip knob on the rear end of the chuck is rotated clockwise to secure the drill in the chuck.

The band 222 locking lever 56 is then moved rearwardly of the attachment 28 and the chuck and drill are inserted as far as possible in the chuck support member 200. The chuck is then rotated such that the arrow 234 on the chuck is aligned with the arrow 230 designated "point split" on the band 222. The locking lever 56 is then moved forwardly to securely hold the chuck in the chuck support 200. The chuck holding or support member 200 is then loosened from the cross-feed table 200 by movement of the handle 264 and the chuck support 200 is aligned with the index mark 270 on the cross-feed table. Then the chuck support 200 is tightened to the cross-feed table by moving the lever 264 to the right, FIG. 16 of the drawing. The feed knob assembly 236 is then rotated until the end of its shaft 238 abuts stop member 310 and the drill is just out of engagement with the grinding wheel 16, FIG. 1 of the drawing.

Using the cross-feed knob 292 the drill is positioned with the center of the drill in line with the right edge 16', FIG. 1, of the grinding wheel 16. Then using the feed knob 236, the drill is slowly fed into the wheel as the cross-feed table with its attached chuck support 200 is pivoted downwardly on the cross-feed shaft 278. This procedure is continued until just before the center of the drill is reached. At this stage the lever 56 is loosened to loosen the band 222 and the chuck is rotated 180° to bring into alignment a second arrow 234, (180° removed from arrow 234) shown in FIG. 10 of the drawing. The chuck is again locked into the chuck holder 200. The drill is then slowly lowered onto the grinding wheel until the feed knob assembly 236 is again into abutment with the stop pin 310. The point splitting should then be complete.

In order to accomplish web thinning, the same procedure is followed except the arrows 234 on the chuck 38 are aligned with the web thinning arrow 232 on the band 222 of the assembly 28.

We claim:

1. A fluted twist drill point splitting and web thinning apparatus for use with a rotary grinding wheel comprising: a standard to be mounted adjacent a rotary grinding wheel, a cross feed shaft having a first end attached to the standard and projecting in a horizontal direction from the standard, a cross-feed table, two pairs of boss portions on the under side of the cross-feed table and between each pair of boss portions space to receive said cross-feed shaft, a pair of bearing plates connecting the pairs of boss portions across said shaft and mounting said cross-feed table to the cross-feed shaft for rotation about the cross-feed shaft and sliding movement on the shaft, a coil spring mounted on the cross-feed shaft between the said bearing plates and urging the cross-feed table away from said standard, threads on a second end of the cross-feed shaft opposite said first end, a cross-feed knob threaded on the cross-feed shaft and engaging the cross-feed table whereby rotation in one direction of the cross-feed knob moves the cross-feed table linearly in one direction and rotation of the cross-feed knob in the other direction results in the coil spring moving the table linearly in the opposite direction, a drill chuck supporting element, means for releasably holding a drill chuck to the drill chuck supporting element, and means mounting the drill chuck support element for limited rotation on said cross-feed table, and further including a stop member mounted on an upper end of the standard off-axis from said cross-feed for limiting rotation of said cross-feed talbe about said cross-feed shaft.

2. The fluted twist drill point splitting and web thinning apparatus as defined in claim 1 further including a feed knob assembly threadably mounted in the chuck holding supporting element, said feed knob assembly positioned to contact said stop member to tilt the chuck suporting element toward and away from the stop member.

* * * * *